US012018472B1

(12) United States Patent
Holbrook

(10) Patent No.: US 12,018,472 B1
(45) Date of Patent: Jun. 25, 2024

(54) MULTI-PURPOSE LID FOR SEPTIC TANK AND AN ASSOCIATED RISER

(71) Applicant: Infiltrator Water Technologies LLC, Old Saybrook, CT (US)

(72) Inventor: Paul R Holbrook, Old Saybrook, CT (US)

(73) Assignee: Infiltrator Water Technologies, LLC, Old Saybrook, CT (US)

( * ) Notice: Subject to any disclaimer, the term of this patent is extended or adjusted under 35 U.S.C. 154(b) by 458 days.

(21) Appl. No.: 16/528,600

(22) Filed: Jul. 31, 2019

(51) Int. Cl.
*E03F 5/10* (2006.01)
*E03F 5/02* (2006.01)

(52) U.S. Cl.
CPC ..... *E03F 5/105* (2013.01); *E03F 5/024* (2013.01); *E03F 2005/028* (2013.01)

(58) Field of Classification Search
CPC ..... B65D 90/02; B65D 90/08; B65D 90/023; B65D 90/024; B65D 90/025; B65D 90/026; B65D 21/0234; B65D 88/526; B65D 88/528; B65D 21/08; B65D 21/083; B65D 21/086; B65D 90/105; B65D 21/0209; B65D 21/0235; B65D 2519/00945; E03F 11/00; E03F 5/00; E03F 5/02; E03F 5/024; E03F 2005/028; E03F 5/105; B60K 2015/03164; B60K 2015/03171; E02D 29/12; E02D 29/121; E02D 29/1409; F16L 47/10
USPC ..... 220/4.16, 795, 4.26, 4.03, 691, 4.06; 52/20, 79.3, 223.5; 285/420, 921, 110, 285/111
See application file for complete search history.

(56) References Cited

U.S. PATENT DOCUMENTS

| | | | |
|---|---|---|---|
| 3,157,304 | A | 11/1964 | Judge |
| 3,655,089 | A | 4/1972 | Tower |
| 4,078,696 | A | 3/1978 | Crisci |
| 5,852,901 | A | 12/1998 | Meyers |
| 6,986,227 | B1 | 1/2006 | Gavin |
| 7,178,686 | B2 | 2/2007 | Bolzer |
| 7,926,510 | B1 | 4/2011 | Terry, III |
| 7,997,031 | B2 | 8/2011 | Meyers |
| 8,789,714 | B1 | 7/2014 | Kruger |
| 9,889,986 | B2 | 2/2018 | Holbrook |
| 2006/0081629 | A1 | 4/2006 | Meyers |
| 2007/0031190 | A1 | 2/2007 | Meyers |
| 2013/0336723 | A1 | 12/2013 | McKinney |

*Primary Examiner* — Andrew D Perreault
(74) *Attorney, Agent, or Firm* — FINNEGAN, HENDERSON, FARABOW, GARRETT & DUNNER, L.L.P.

(57) ABSTRACT

A kit, and an assembly formed with components of the kit, comprises a fitting for the top of a septic tank or water tank, one or more frusto-conical rings shaped to interconnect with an identical ring to form an undulating wall riser that extends upwardly from the tank top fitting, and a lid. The lid is shaped for multi-purpose use: closing off the opening of either the large end or the small end of a ring/riser—whichever is uppermost, or closing off the fitting when there is no riser. Joints between the rings of the riser, and between a ring/riser and the fitting of a tank, are held together by latching tabs and/or screws. A fitting may be integral with a tank top.

6 Claims, 8 Drawing Sheets

MULTI-PURPOSE LID FOR SEPTIC TANK AND AN ASSOCIATED RISER

TECHNICAL FIELD

The present invention relates to molded plastic articles that are useful in connection with tanks that are buried in soil, including water tanks and septic tanks which hold and treat wastewater.

BACKGROUND

Septic tanks and other water storage tanks suited for burial in soil are commonly made of concrete, fiberglass reinforced resin, or thermoplastics. Septic tanks used for residential on-site wastewater disposal systems often have capacities of 300 to 1500 gallons. Typically, such tanks are buried beneath the surface of soil and have lids that close tank top openings. The openings are typically 16 to 24 inch in diameter, to facilitate original manufacture and to enable maintenance when installed in the field. When the tank is buried deep in the soil there is often a desire or requirement to have the lid at or near to the soil surface and not at the top of the tank. To accomplish such, a tubular structure called a riser may be affixed to the tank at the top opening; and the lid is then put on the top opening of the riser. It is desirable that the joint between the riser and the tank top, and between a lid and a component, inhibit any significant migration of soil or subsurface water into the riser or tank.

Many commercially available risers are made of molded plastic and have been comprised of short straight cylindrical sections which can be interconnected in the field to achieve the desired length of riser assembly. Cylindrical riser sections cannot be nested for economic shipment and storage. In comparison, risers which are formed by interconnecting sections having frusto-conical shape (in short, conical shape) can be nested. When mated to each other, the assembly of such rings provides a riser which has an undulating vertically running wall. Such kind of undulating wall risers are described in commonly owned U.S. patent application Ser. No. 14/444,960 entitled "Multi-ring plastic storage tanks and risers," filed on Jul. 28, 2014 and in U.S. patent application Ser. No. 15/432,780 entitled "Multi-ring plastic riser with tab connectors," filed on Feb. 14, 2017.

In pursuit of having a good fit at the joint between a riser or a lid, it is common to provide a fitting at the tank top opening. The fitting may be integral with the tank, for instance when the tank is made by injection molded plastic; or the fitting may be attached to a tank top where there is a comparatively rough opening, such as when the tank is blow molded or made of concrete.

When the riser is an undulating wall riser assembly, the opening to be sealed by a lid at the top of the riser will have one of two different diameters, i.e., the small conical end or the large conical end or a riser section (ring). And possibly the tank opening without a riser will require a still different diameter or shape. Thus, in one approach a supplier of tanks and risers will provide lids of different size and shape, for each of the possible openings that are presented for closure. Commonly owned U.S. patent application Ser. No. 15/365,922 entitled "Undulating wall plastic risers and tanks with lid," filed Nov. 20, 2016, describes a lid for an undulating wall riser, where the lid fits either the small end or the big end of a conical ring—whichever end forms the top of a desired length riser assembly. However, for economy of manufacturing and minimization of inventory of goods, there is a need for one lid that forms a good joint with any of the tank top fitting, the small end or the large end of an undulating wall riser, including risers described in aforementioned application Ser. No. 15/432,780, where the conical riser sections have tab engagement features at each end.

SUMMARY

An object of the invention is to provide a combination of riser, tank top opening, and lid for a water tank or a septic tank where the lid is useful for the multiple purposes of closing and sealing either the opening at the top of the tank when there is no riser, or closing and sealing the uppermost end of a riser when a riser is present, in context that the riser uppermost end opening diameter may be one of two different diameters. A further object is to have such a combination where the tank fitting and lid are economic to manufacture and ship.

In embodiments in accord with the invention, a kit is comprised of a first ring having a frusto-conical wall circumscribing a length axis, a small end, and a large end. Each end has an associated opening and diameter. The kit comprises a second ring identical to the first ring and the first and second rings can be mated at joints comprising either like-large ends or like-small ends. An embodiment of fitting in the kit comprises a flange which is attachable to, attached, or integral with, the top wall of a septic tank or other like tank. A fitting embodiment has a web running radially from the flange to a rim which defines the periphery of an opening in the center of the fitting. A ridge runs around the web in proximity to the rim of the fitting and is shaped to mate sealingly with the small end of a ring. A lid is shaped for closing off a user-chosen one of any of (a) the opening of the fitting, (b) the small end opening of a ring and (c) the large end opening of a ring. A lid embodiment has a skirt for mating sealingly with a large end of a ring and a gasket on the ring end. And preferably there is a gasket within a channel defined by two downwardly-extending fins that run around the underside of the lid, for mating sealingly with a chosen one of the small end of a ring or the ridge on the fitting.

In further embodiments of the kit, each end of each ring has a plurality of tabs for engagement with rim segments of the other identical ring, and for engagement with the rim of the fitting. In still further embodiments, the fitting comprises a plurality of bosses; the bosses are spaced apart around the rim of the fitting and each boss mates with one of a plurality of bosses that are spaced apart around the small end of the first ring. Screws may be run axially through a boss of one part into the aligned boss of the other part, to hold the parts together.

In embodiments in accord with the invention, a wastewater treatment assembly comprises components of the kit attached to each other in different ways. In one embodiment the fitting is attached to or integral with the top wall of a septic tank or like water tank; a riser which is the small end of a ring is mated at a joint with the fitting; and a lid forms the uppermost portion of the assembly. When there is one ring, the lid closes the large end of the ring. When the riser comprises a second ring mated with the first ring, the lid closes the small end of the second riser. When there is no riser, the lid sets on the fitting and closes the opening of the fitting.

The foregoing and other objects, features and advantages of the present invention will become more apparent from the following description of preferred embodiments and accompanying drawings.

DESCRIPTION

A riser is an open ended vertically-extending structure which may be closed by a lid when positioned on the top of a septic tank or a like water tank. Risers for which the present invention is useful comprise one or more interconnected sections which have a frusto-conical shape (in short, they are conical). When the riser sections are interconnected, the riser presents an exterior wall surface which undulates in the vertical direction. A conical riser section is often hereafter interchangeably called a ring. A lid may sometimes be referred to as a cover.

Figure 1:
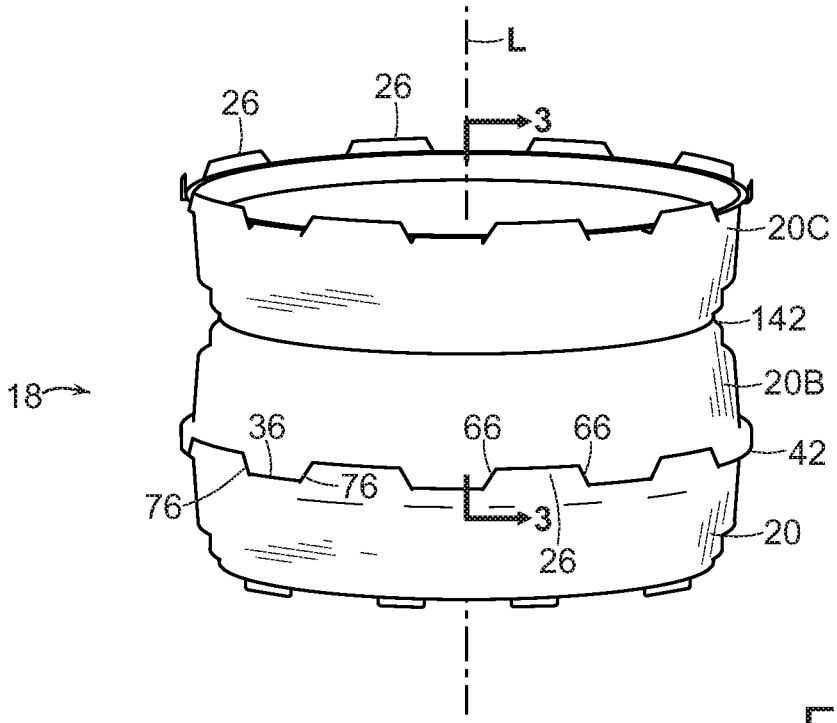
FIG. 1 is a perspective view of a riser which is an assembly comprised of identical risers.
Figure 2:
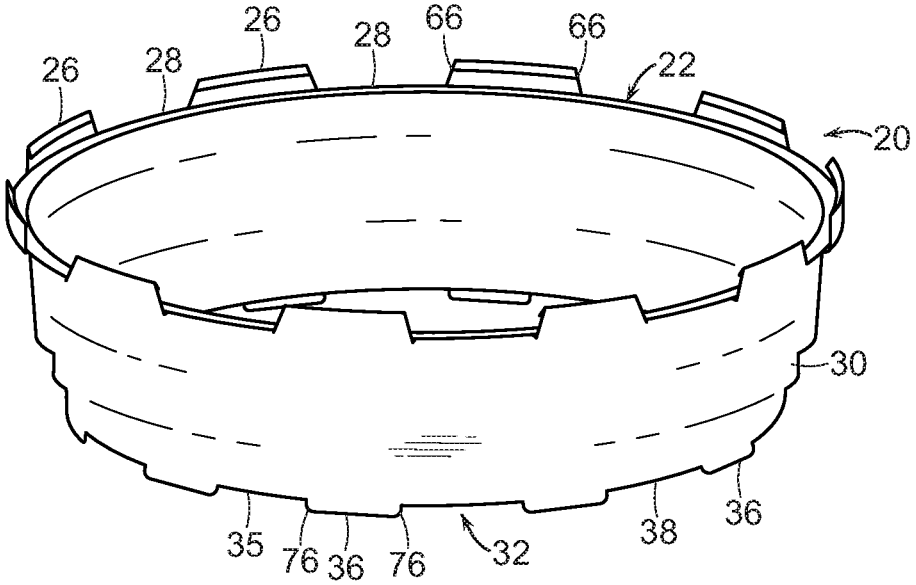
FIG. 2 is a perspective view of a riser which is part of the assembly of FIG. 1.
Figure 3:
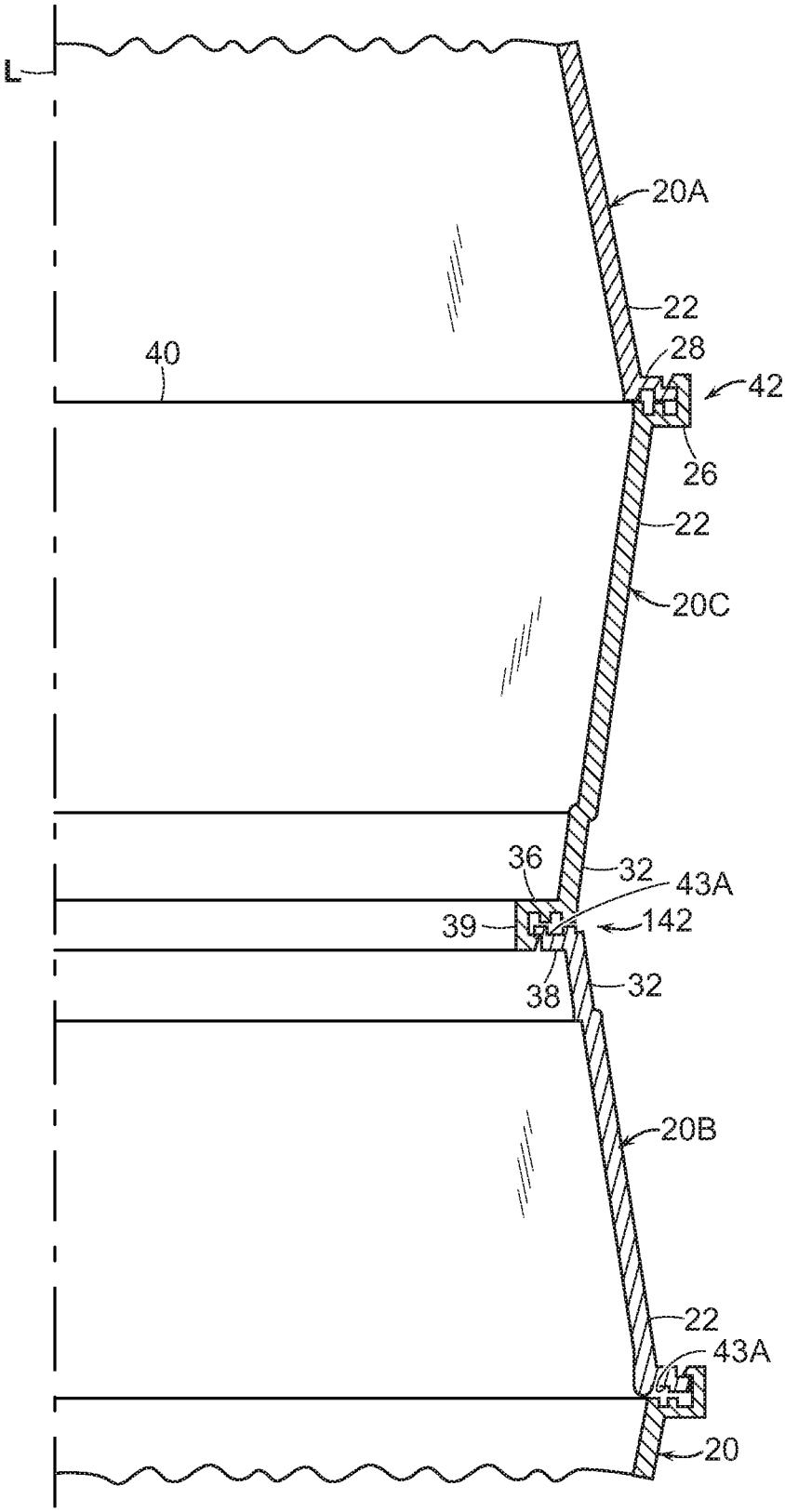
FIG. 3 is a partial vertical cross section through the riser assembly of FIG. 1, with an additional riser added at the top of the assembly.

Embodiments of undulating wall risers are described in the disclosures of commonly owned U.S. patent application Ser. Nos. 14/444,960, 15/365,922, and 15/432,780 that are referred to in the Background. The disclosures of the foregoing applications are hereby incorporated by reference in their entireties. The present invention comprises a fitting for a tank and a lid, both configured to be particularly useful with riser embodiments which accord with those described in the aforementioned Ser. No. 15/432,780 application, and presently sold commercially as EZsnap® risers. FIG. 1 through FIG. 3 show riser assemblies that are described in foregoing '780 application. Each ring mates with the other ring at a joint where there are engagement features comprising tabs that clamp the rings to each other.

FIG. 1 is an elevation perspective view, showing three identical rings (riser sections) 20, 20B, 20C that are joined to each other as riser assembly 18. A single ring 20 is shown in FIG. 2. FIG. 3 is a half-cross section of part of the assembly of FIG. 1, with addition of a further upper riser ring 20A, to form assembly 18A. Referring to FIG. 3, the small end of ring 20C mates with the small end of ring 20B at joint 142. The large end of ring 20A mates with the large end of ring 20C at joint 42. The wall of the riser assembly undulates in the lengthwise direction, so the wall is close to the central axis at circumferential joints 142 and distant at circumferential joints 42. A riser can comprise a single conical ring 20, as described below. A riser assembly may comprise two or more mated and latched-together conical rings; such an assembly is sometimes simply referred to also as a riser herein. When installed on a septic tank, a riser is typically fastened to a component such as fitting 44 shown in FIG. 4 and described below. The fitting may be integral with the tank when the tank is injection molded, for example, with tanks described in U.S. Pat. No. 8,740,005. When a tank has an imprecise opening, as a blow molded or rotational molded tank or concrete tank typically has, the fitting may be characterized as an adapter that attaches to the top of the tank. The attachment may be made mechanically or by welding or by adhesive bonding. The fitting thus provides a desired consistent and precise feature for attachment of a lid or a riser.

An exemplary ring 20 may have a vertical height of about 15 cm (about 6 inch), a larger diameter end of about 69 cm (about 27 inch) and a smaller diameter end of about 58 cm (about 23 inch). Other rings may have heights in the range 2 to 18 inches (5 to 46 cm). Joints between several identical rings 20 are formed by tabs on one part that engage rim segments on the mating part by latching to them. An exemplary riser ring (and any lid or tank fitting) may be made of injection molded thermoplastic, such as polyethylene or polypropylene, with a wall thickness of about 4.5 mm (about 0.18 inches). Alternative plastic materials may be used.

Exemplary ring 20 has a lengthwise central axis L, around which is centered a wall 30 that generally has the shape of a truncated hollow cone. The wall of ring 20 has opposing ends 22, 32. End 22 has a larger diameter than does smaller end 32. The wall of an exemplary ring is preferably inclined at an about 7 degree angle to the lengthwise axis L, more generally, the wall angle is within the range 5 to 20 degrees.

As illustrated by FIG. 1 and FIG. 2, the larger end 22 of a ring 20 is characterized by a plurality of integral tabs 26 which are circumferentially spaced apart by rim segments 28. The tabs extend in the lengthwise (axial) direction from the exterior surface of the wall of the ring. Each tab ends at a lip portion, for latching onto the rim segment 28 of a mated like ring. The inner edges of the lips are disposed around a circle. The outer edges of the rim segments of the mating part are disposed around a circle which is slightly smaller in diameter than the circle around which lay the lip edges. Thus when the large end of one ring is pushed against the large end of a like ring, the angled ends of tabs cause them to spring away from the rim segment each contacts, and each tab then elastically springs back to latch with its respective mated rim segment. When exemplary joint 42 between risers is formed, the plurality of tabs 26 of one ring are engaged with a plurality of rim segments 28 of a mating ring. See FIG. 3. Likewise, joint 142 is analogously formed between the smaller ends of mated rings. A gasket (O ring) is typically positioned within one or both circumferential channels 43, 44A at the opposing ends of a ring, but for clarity gaskets are omitted in FIG. 3.

Figure 4:
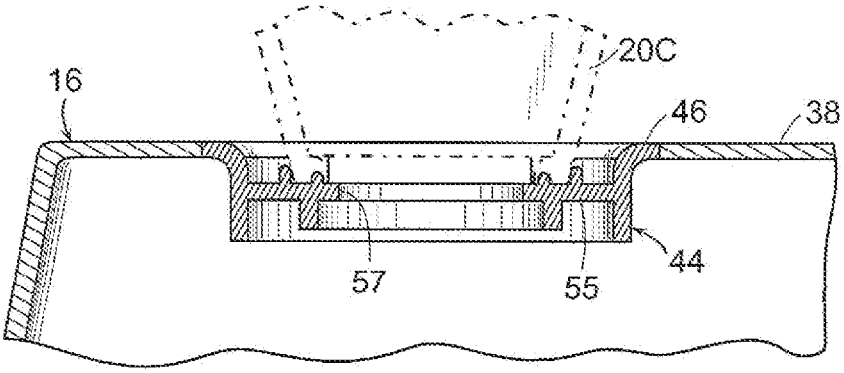
FIG. 4 is a partial lengthwise cross section of a septic tank having a fitting in the tank top. Also shown is a phantom conical wall ring that is mated with the fitting.

FIG. 4 is a partial lengthwise cross section of an assembly comprising septic tank 16 and fitting 44 in tank top wall 38. Ring 20C, shown in phantom, is mounted on the fitting. Fitting 44 may be integral when the tank is injection molded, as illustrated by FIG. 4. Alternatively, the fitting may be separately molded and positioned within an opening in the top of a tank by being bonded or mechanically attached to the top wall. In such circumstance the fitting might be referred to as an adaptor. With respect to the inventions described or claimed here, a septic tank shall have as an equivalent any water base liquid storage tank that is of comparable shape and size to a common commercial plastic septic tank.

Figure 5:
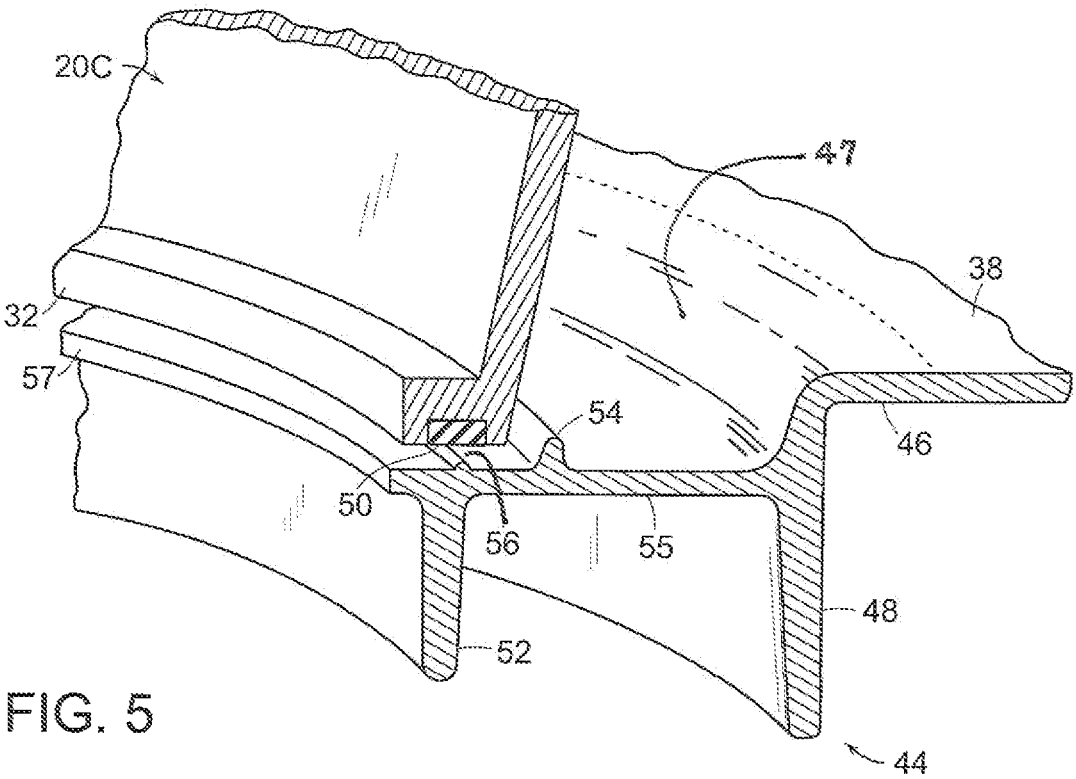
FIG. 5 is a perspective partial cross section of a conical riser setting on a fitting at the top of a tank.
Figure 6:
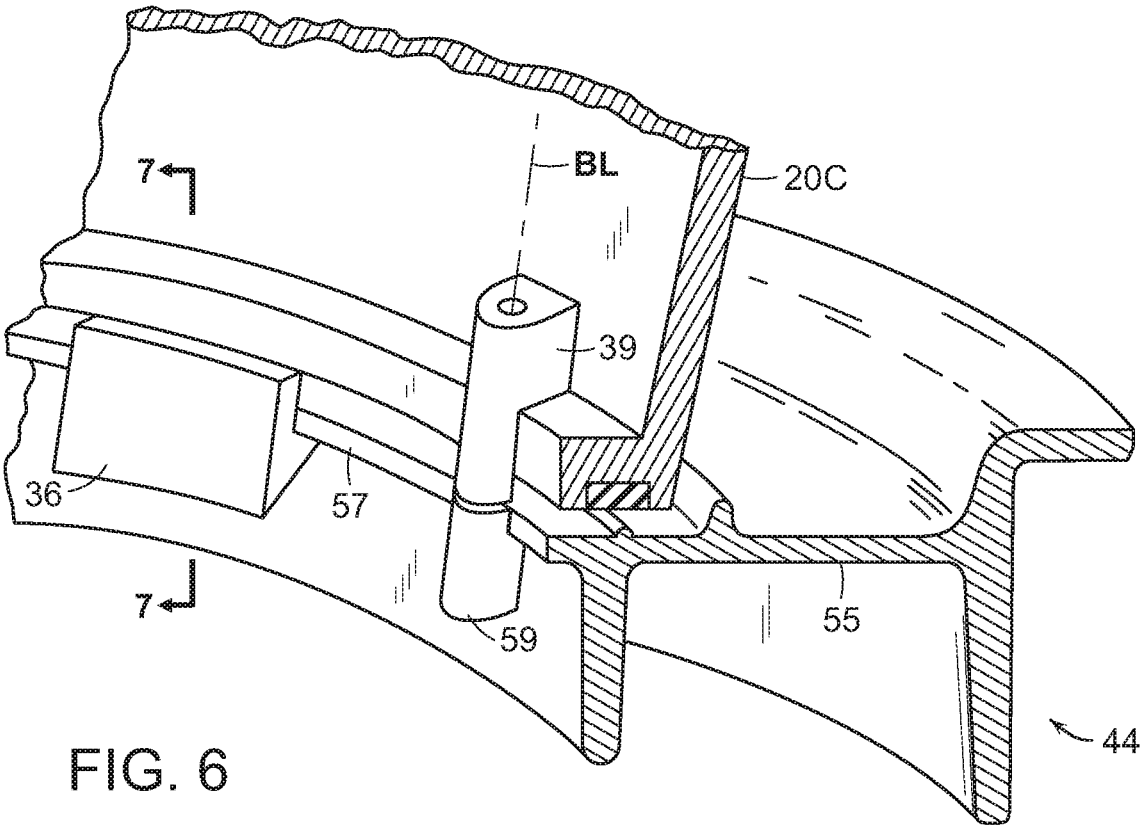
FIG. 6 is a perspective partial cross section showing a conical riser that comprises tabs and bosses setting on a fitting that further comprises bosses.

FIG. 5 is a partial cross section of fitting 44 in combination with ring 20C. FIG. 5 illustrates features of the fitting and shows how the small end of ring 20C sealingly mates with the fitting. For clarity, preferred tabs and/or optional engagement screws, both for securing the ring to the fitting are not shown in FIG. 5, but are shown in FIG. 6. In some instances, the dead weight of the ring/riser and surrounding soil friction may be sufficient to hold the ring in mating contact with the fitting and with another like ring. In other instances, external clamps or fittings may be used to hold a ring to a fitting or to hold one ring to a mated second ring.

Figure 4A:
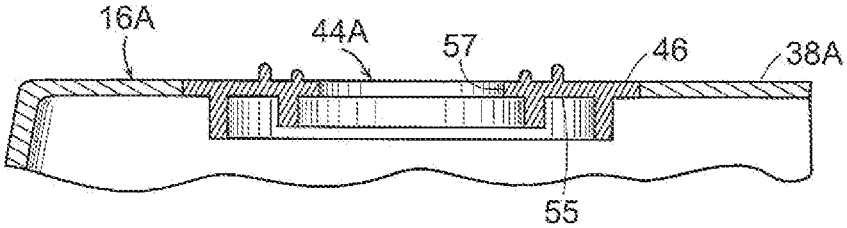
FIG. 4A is a partial lengthwise cross section of a septic tank like the view of FIG. 4, with a different embodiment fitting.

Referring to FIG. 5, fitting 44 comprises a circular flange 46 which is the outermost portion of the fitting. In this embodiment the flange is contiguous with the tank wall 38. Flange 46 runs radially inwardly to step 47 which is attached to or integral with web 55, which web runs radially inward from step 47 to rim 57. See FIG. 8 also. Rim 57 defines the bore, i.e., the periphery of the opening of the fitting. The diameter of rim 57 and the inside diameter of small end 32 of ring 20C (excluding the tabs mentioned below) are approximately the same (i.e., they are within about an inch of each other when the opening is in the range 16 to 24 inch diameter). FIG. 4A is like FIG. 4. It shows fitting 44A, an embodiment which is like fitting 44 but lacks a step 47. While the rim and other parts of a fitting, and the risers, are preferably circular as shown, in the generality of the invention, the rim of a fitting and other fitting portions may be non-circular with respect to the vertical axis. For instance, an opening of a component may be defined by interconnected chords of circles. Likewise, in the generality of the invention, rings may be non-circular. For example, rings may be out-of-round or polygonal in cross section, such non-circular rings will preferably have angled sides to enable the rings to nest for shipment. When a ring or fitting of the present invention has an opening or end that is non-circular, a reference herein to the diameter of such an opening or end shall be construed as a reference to the diameter of the best-fit circle for the opening or end.

Referring again to FIG. 5, fitting 44 also comprises an outer skirt 48 and an inner skirt 52, both of which run downwardly (i.e., axially, or lengthwise) from the bottom surface (or underside) of web 55, and in the direction of the tank interior concavity when the fitting is in working position. The skirts, along with step 47 when present, provide structural stiffness to the fitting. Other stiffening structure may be used in addition to, or in substitution of, some of the foregoing features. For instance, gussets may run between the skirts, or outwardly from the outer skirt; or an array of gussets may replace one or both of the skirts.

When fitting 44 is integrally molded with the tank top wall the demarcation between the flange and the tank wall is arbitrary. In an example, for a fitting that has a 24 inch opening, the flange portion of the fitting may be characterized as being about one inch wide measured from the step 47.

Extending upwardly from the top surface of web 55 of fitting 44 is an outer circular ridge 54 and an inner circular ridge 56 which has comparatively both smaller height and smaller diameter. The outer ridge helps locate a ring or lid placed on the fitting and aids stiffness. The outer ridge may have different cross sections than the gently rounded triangular cross section of exemplary fittings. For example, the cross section may be rectangular or the ridge may be a canted or sloped structure. The inner ridge 56, which is positioned close to the rim of the fitting, aids in forming a sealed joint with gasket 50 of ring 20C, which gasket is set within a circumscribing channel at the small end of ring 20C. Alternative structures useful as the inner ridge are discussed below.

Figure 7:
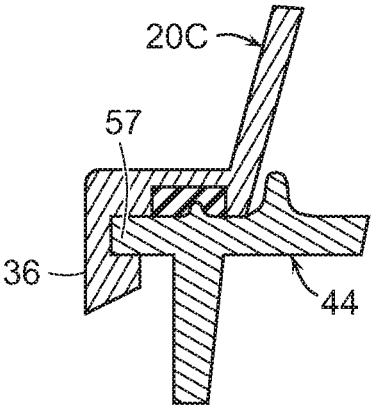
FIG. 7 is a vertical cross section of a portion of the assembly of FIG. 6

FIG. 6 is a view of the fitting and ring of FIG. 5 with addition of tab 36 and boss 39 on ring 20C, and boss 59 on fitting 44. With reference to FIGS. 1 to 3 herein, ring 20C comprises a plurality of tabs 36 and a plurality of bosses 39 that are located between the spaced apart tabs. In FIG. 6, tab 36 is shown as it is engaged with rim 57 of the fitting. When a ring is axially pushed down onto the fitting, each elastic material tab 36 deflects radially inwardly, and then outwardly to engage rim 57. FIG. 7 is a detail of FIG. 6, showing the resultant engagement of tab with rim.

Fitting 20C also comprises a plurality of spaced apart bosses 39, as described more particularly in aforementioned application Ser. No. 15/432,780. In the embodiment of fitting 44 shown in FIG. 6, a plurality of bosses 59 are spaced apart around rim 57; only one boss 59 is shown in FIG. 6. The bosses 59 are spaced apart around the rim so they align with a plurality of bosses 36 of ring 20C. Each set of mated bosses 39, 59 preferably have holes along axis BL (see FIG. 6), thus enabling a screw to be passed through boss 39 of a ring and threadingly secured within boss 59 of the fitting, thereby to hold the ring to fitting.

Figure 8:
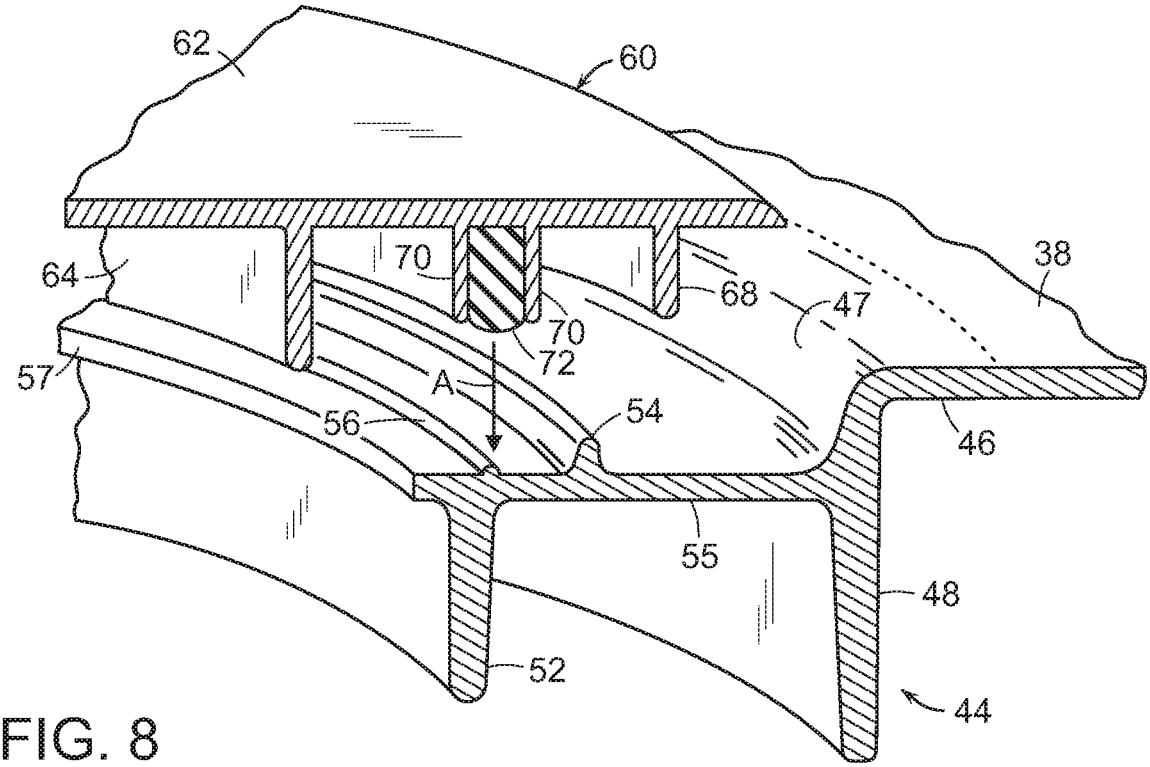
FIG. 8 is a perspective partial cross section of a lid being set onto a fitting like the fitting shown in FIG. 5

FIG. 8 shows fitting 44 along with an embodiment of lid 60. The arrow A indicates how the lid mates with the fitting. Lid 60 has a top 62, the surface of which may be flat or modestly convex. Descending downwardly from the underside of the top are an outer skirt 68, an inner skirt 64, and two integral fins 70 positioned between the skirts. Fins 70 define a circular channel within which is contained resilient gasket material 72. In an alternative embodiment, not shown, there may be only one fin with the gasket material is adhered to the one fin and the underside of the lid. When the lid is seated on the fitting, skirt 64 fits within the bore of rim 57 and gasket 72 forms a seal with inner ridge 56 of the fitting.

Figure 9:
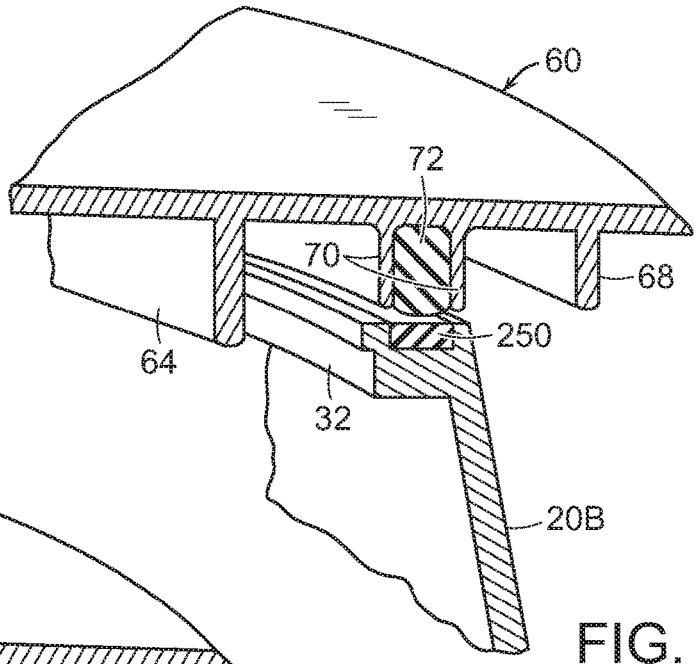
FIG. 9 is a perspective partial cross section showing how a lid fits the small end of a ring.

FIG. 9 shows lid 60 of FIG. 8 setting on and closing off the upper end of ring 20B. Lid 60 is engaged with the small end 32 of ring 20B. Gasket 250 is within the circular channel at the end 32 of the ring 20B for use when two small ends of rings are mated. In the FIG. 9 assembly, gasket 250 forms a seal with gasket 72 that is contained between fins 70.

Figure 9A:
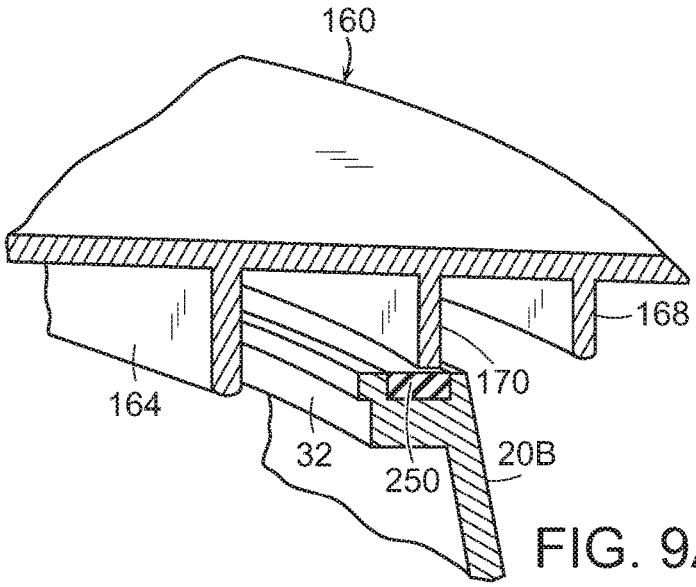
FIG. 9A is like FIG. 9, showing an alternate embodiment of lid.

In an alternative embodiment of lid 160 shown in FIG. 9A, the fins 70 and gasket 72 are replaced by a middle skirt 170, located between inner skirt 164 and outer skirt 168. The skirt 170 forms a seal with gasket 250. However, to make a desired good seal with a fitting 44 (i.e., with ridge 56 thereof), a lid 160 embodiment necessitates that a gasket (or sealant) be placed on fitting 44 at the location of ridge 56. Alternately, the fin 56 is formed of gasket type material. See FIG. 12(*d*), discussed below.

Figure 10:
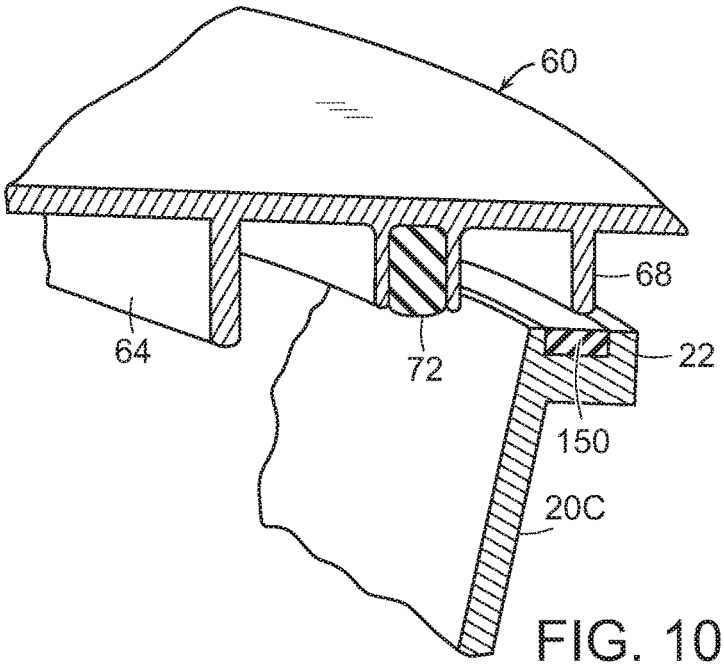
FIG. 10 is a perspective partial cross section showing how a lid fits the large end of a ring.

FIG. 10 shows the lid 60 of FIG. 8 engaged with the large diameter end 22 of ring 20C. Skirt 68 presses on gasket 150 which is contained within the circumscribing channel of end 22 of the ring 20C to form a sealed joint. Gasket 72 does not have any function in this mode of lid use. The tabs 36 are not shown in FIG. 10; they may be present but have no function with respect to engaging the lid. The length of outer skirt 68 of the lid is sufficient to provide room under the top of lid 60 to accommodate tabs 36 which extend upwardly at end 22.

Figure 11:
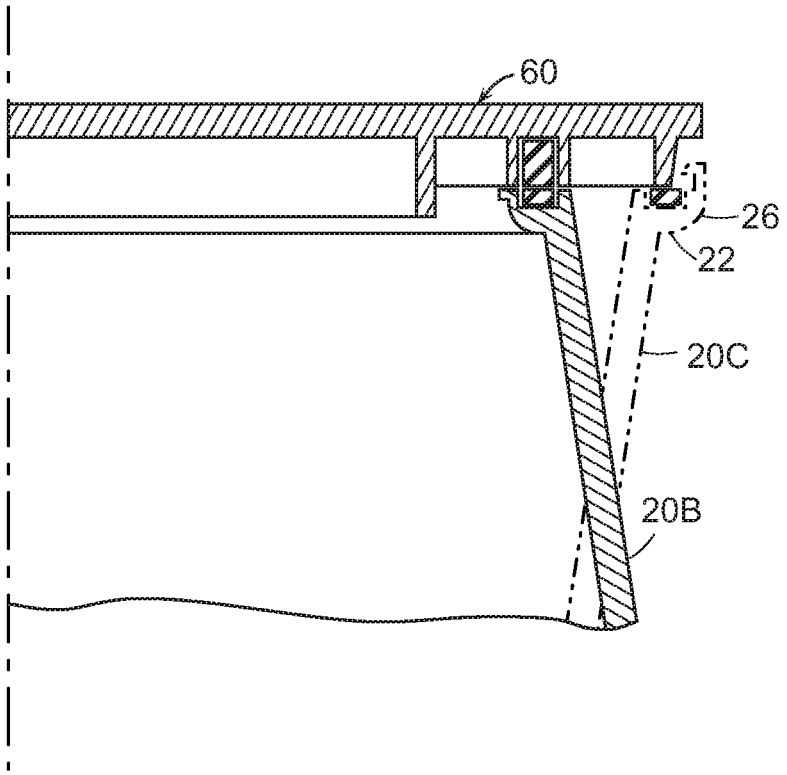
FIG. 11 is a partial cross section of a ring and lid showing how the lid fits the small diameter end of a ring. The Figure also shows in phantom how the lid fits the larger diameter end of the same ring.

FIG. 11 is a partial vertical cross section of ring 20B with lid 60 mounted thereon to close the smaller end of the ring, as described in connection with FIG. 9. The Figure also shows phantom ring 20C, illustrating how the lid alternatively may close off the larger diameter end of ring 20C, as described in connection with FIG. 10.

Figure 12:
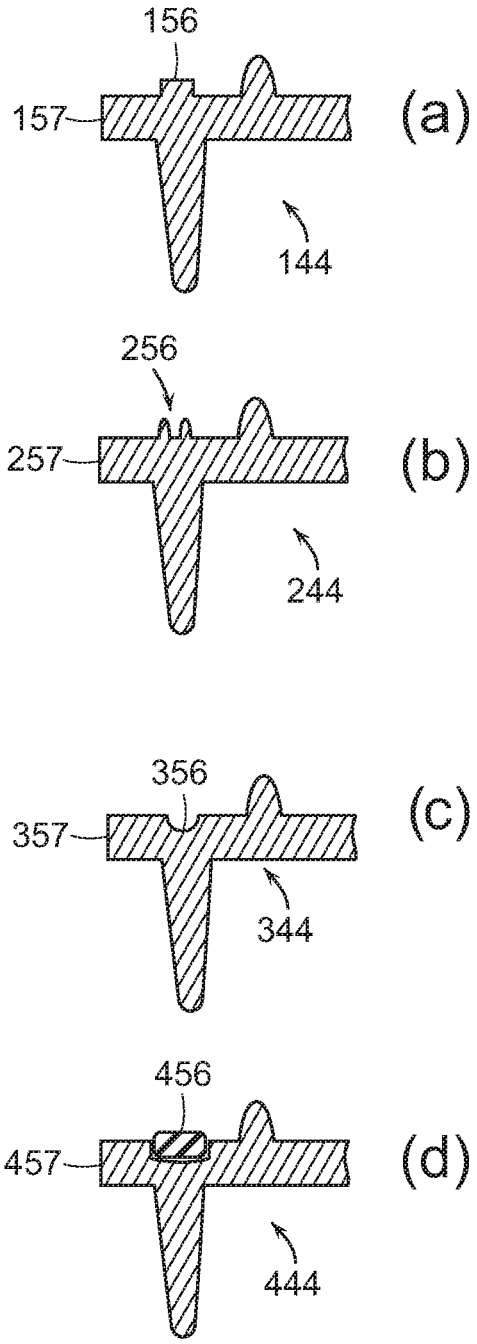
FIG. 12 (*a*), (*b*), (*c*) and (*d*) are each a partial cross section of a portion of a fitting near the fitting rim, showing different embodiments of rings.

FIG. 12 shows variations in the configuration of fittings, in particular, embodiment of fittings which have web upper surface features that are different from ridge 56 of fitting 44 may fulfil good sealing. Each drawing shows of the portion web which is close to the rim of the fitting. Each drawing designates the rim by a prefix digit followed by the number 57. FIG. 12(*a*) shows square cross section ridge 156 on fitting 144. FIG. 12(*b*) shows a two-hump ridge feature 256 on fitting 244. FIG. 12(*c*) shows a ridge feature which is a depression 356 on fitting 344. FIG. 12(*d*) shows a ridge comprised of gasket material 456 on fitting 444. The FIG. 12(*c*) and FIG. 12(*d*) embodiments might mate usefully with gasket 72 of lid 60 or with fin 170 of lid 160 (shown in FIG. 9A) or with fin 273 of lid 260 (shown in FIG. 13A).

While the aforementioned gaskets are the best way to get good fit and sealing between mated components, it is within contemplation that integral plastic material of the lid/ring may be substituted for a gasket, when the nature of the installation of other factors indicate a gasket type seal is either not necessary or not wanted. In such instances, the gasket may be eliminated and the fins and skirt of the lid will mate with the fitting surface or the end of a ring; or the gasket may be replaced by integral molded plastic portions of the lid and ring.

Figure 13:
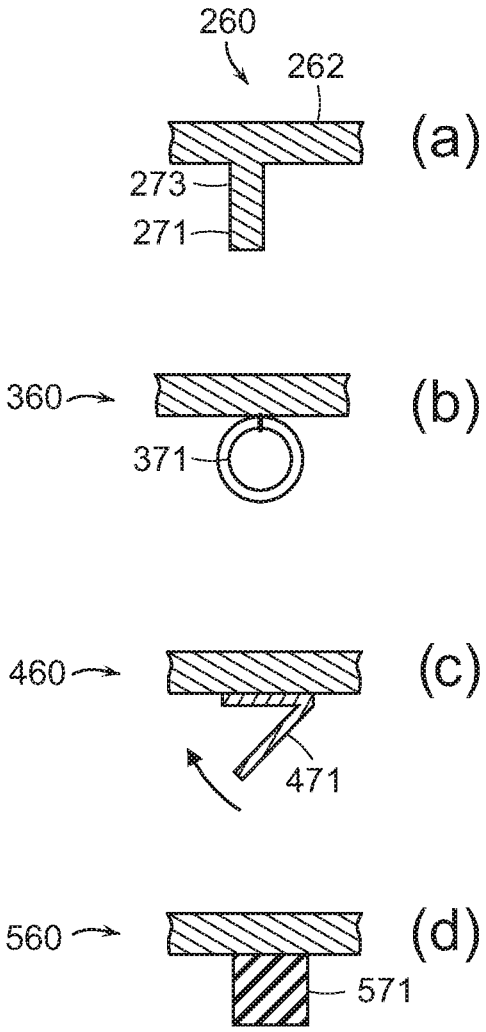
FIG. 13 (*a*), (*b*), (*c*), (*d*) are each a partial cross section of a portion of a lid, showing different embodiments of gasket and equivalent sealing structures.

Gaskets mentioned herein may comprise a resilient sealing substance such as filled EPDM (ethylene propylene diene monomer) rubber. Other known materials may be substituted for resiliently making a seal with a semi-rigid structure such as polypropylene fin 28. The term "gasket" shall comprehend other structures configured for making a seal with a mating thermoplastic surface such as fin 28 (or another gasket that is in place of fin 28). Examples of alternative embodiment lid gaskets and equivalents are illustrated by the fragmentary cross sections of portions of the tops lids, shown in FIG. 13. FIG. 13(*a*) shows gasket 271 which is at the end of fin 273 that extends downwardly from the underside of the top 262 of lid 260. FIG. 13(*b*) shows flexible hollow tube 371 which is pinned or adhered to the underside of the top of lid 360. In an alternative not shown, tube 371 may be filled. FIG. 13(*c*) shows a leaf seal 471 that is attached to the underside of the top of lid 460. FIG. 13(*d*) shows a gasket 571 adhered to the underside of the top of lid 560. Gasket 571 may be like gasket 72 in FIG. 9, in absence of any fins 70.

While embodiments of the invention have been described in connection with rings which engage each other by means of tabs that elastically latch together two rings at a joint, and tabs that latch the small end of a ring to a fitting, the invention fitting and lid combination may be used with conical rings/risers which lack said tabs and are held together instead by dead weight, by means of screws with or without bosses, by adhesives, and by exterior clamps or hold-downs.

Thus it can be appreciated that the lid of the present invention has multiple uses, and only one configuration of lid is needed to be supplied when a septic or other tank has a fitting of the present invention which is configured to receive the small end of an undulating wall riser comprised of identical conical rings.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. An assembly, useful as part of a wastewater treatment system, comprising:

a fitting having a flange which is attachable to, or capable of being integral with, the top wall of a septic tank, a rim defining the periphery of an opening in the fitting, a web, having a top surface, running radially inward from the flange to the rim, a circumscribing first ridge on the web top surface in proximity to the rim, and a circumscribing second ridge on the web top surface, the second ridge larger in circumscribing dimension than the first ridge; and a lid, positioned on top of the fitting, the lid having a top, a circumscribing inner skirt extending downwardly from the top, a circumscribing outer skirt extending downwardly from the top, the outer skirt larger in circumscribing dimension than the inner skirt, a pair of spaced apart circumscribing fins, each fin extending downwardly from the top, the fins defining a circumscribing channel therebetween, a circumscribing gasket located in said channel;

wherein, said inner skirt of the top is positioned within said fitting opening in close proximity or in contact with said fitting rim; and, wherein said gasket of the top is in contact with said first ridge on said top surface of the fitting.

2. The assembly of claim 1 wherein at least one ridge of the fitting comprises gasket material.

3. The assembly of claim 1 further comprising a septic tank or a water tank having a top wall, wherein the flange of the fitting is attached to or integral with said top wall.

4. The assembly of claim 1 wherein the flange comprises a step where the flange meets the web.

5. The assembly of claim 1 wherein the fitting further comprises a first skirt and a spaced apart second skirt, each skirt descending downwardly from the web.

6. The assembly of claim 1 wherein the fitting and the lid are made of thermoplastic.

* * * * *